United States Patent [19]

Blacklin et al.

[11] Patent Number: 4,835,924

[45] Date of Patent: Jun. 6, 1989

[54] SELF-GRIDDING FLOORING SYSTEM

[75] Inventors: Peter A. Blacklin, Baltimore; Jonathan D. Bell, Ellicott City, both of Md.

[73] Assignee: Tate Acess Floors, Jessup, Md.

[21] Appl. No.: 942,704

[22] Filed: Dec. 17, 1986

[51] Int. Cl.[4] ..... E04B 5/02

[52] U.S. Cl. ..... 52/263; 52/747

[58] Field of Search ..... 52/126.6, 263, 741, 52/747

[56] References Cited

U.S. PATENT DOCUMENTS

| | | | |
|---|---|---|---|
| 1,836,964 | 12/1931 | Grigsby | 52/387 |
| 1,861,359 | 5/1932 | Pyron | 52/387 |
| 2,042,412 | 9/1936 | Aberson | 52/387 |
| 2,867,301 | 1/1959 | Benton . | |
| 2,956,653 | 10/1960 | Liskey, Jr. . | |
| 3,067,843 | 12/1962 | Rushton et al. . | |
| 3,096,695 | 7/1963 | Reinhardt | 404/43 |
| 3,130,470 | 4/1964 | Bowden et al. . | |
| 3,199,257 | 8/1965 | Spiselman et al. . | |
| 3,318,057 | 5/1967 | Norsworthy . | |
| 3,398,933 | 8/1968 | Haroldson . | |
| 3,420,012 | 1/1969 | Liskey, Jr. et al. . | |
| 3,616,584 | 11/1971 | Sartori et al. . | |
| 3,811,237 | 5/1974 | Bettinger . | |
| 3,861,098 | 1/1975 | Schaub | 52/263 |
| 3,924,370 | 12/1975 | Cauceglia et al. . | |
| 3,938,295 | 2/1976 | Tate . | |
| 4,016,357 | 4/1977 | Abrahamsen . | |
| 4,085,557 | 4/1978 | Tharp . | |
| 4,258,516 | 3/1981 | Mori et al. . | |
| 4,279,109 | 7/1981 | Madl | 52/263 |
| 4,438,610 | 3/1984 | Fifer | 52/126.6 |
| 4,558,544 | 12/1985 | Albrecht et al. . | |
| 4,570,397 | 2/1986 | Creske . | |
| 4,593,499 | 6/1986 | Kobayashi et al. . | |
| 4,656,795 | 4/1987 | Albrecht | 52/263 |
| 4,719,727 | 1/1988 | Cooper | 52/126.6 |

FOREIGN PATENT DOCUMENTS

| | | | |
|---|---|---|---|
| 1903535 | 10/1970 | Fed. Rep. of Germany . | |
| 2116407 | 10/1972 | Fed. Rep. of Germany . | |
| 2122976 | 11/1972 | Fed. Rep. of Germany . | |
| 1306680 | 8/1962 | France . | |
| 1475402 | 3/1967 | France . | |
| 2522045 | 8/1983 | France | 404/43 |
| 1335829 | 10/1973 | United Kingdom . | |

OTHER PUBLICATIONS

*TOTO* Brochure in Japanese.

*SHODEN* Brochure in Japanese.

"*Concrete Products*", Mar. 1986, vol. 89, No. 3.

*Primary Examiner*—John E. Murtagh

*Attorney, Agent, or Firm*—Oblon, Fisher, Spivak, McClelland & Maier

[57] ABSTRACT

A self-gridding flooring system and method for installing the same in which various disclosed embodiments of gridding members are used for contacting and spacing the panels from one another as they are installed, thereby eliminating the necessity of measuring and establishing a gridding in advance of the installation of the panels. The method and apparatus provides a way of assuring that the installed panels are sufficiently spaced apart that any one or more of the panels may be removed and replaced by any geometrically similar replacement panel or panels having the same nominal dimensions and the same tolerance ranges without interference between the replacement panels and the previously-installed panels contiguous thereto. The invention is suitable for use with panels having legs and panels not having legs, and further is suitable for panels having any overall configuration, including rectangular panels and triangular panels.

6 Claims, 9 Drawing Sheets

FIG. 1 PRIOR ART
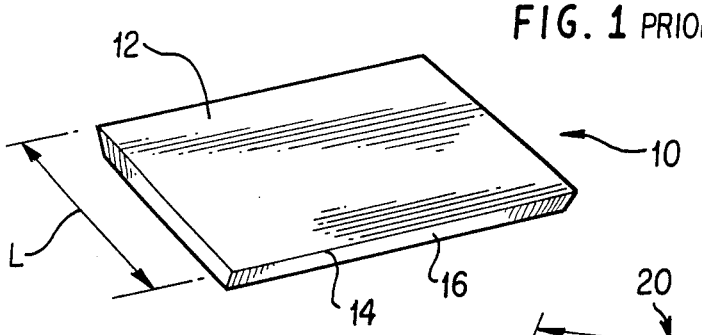
FIG. 2
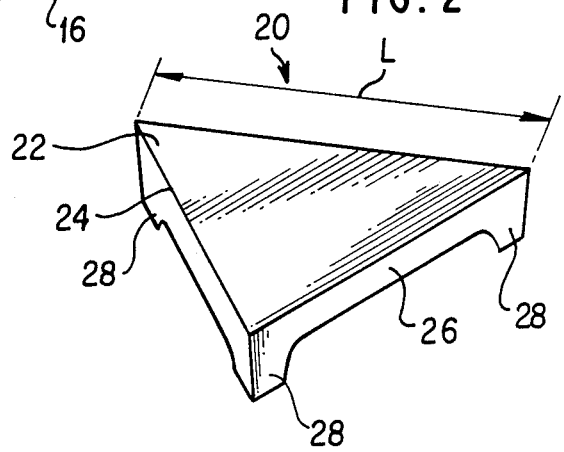
FIG. 3
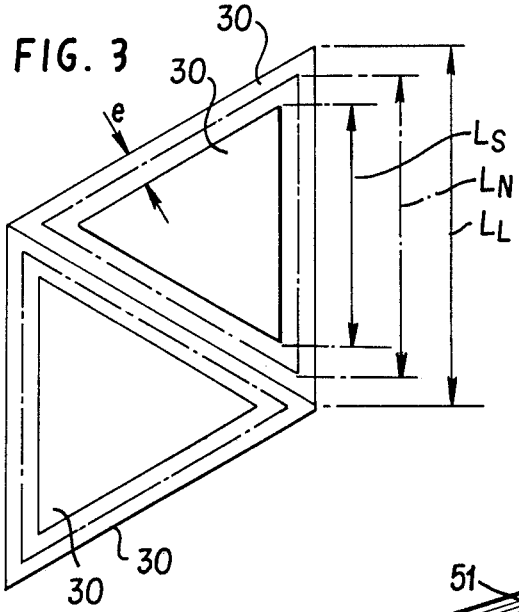
FIG. 4
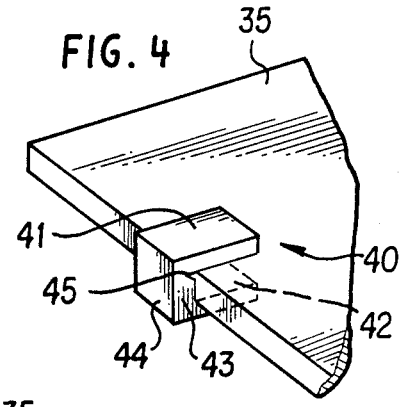
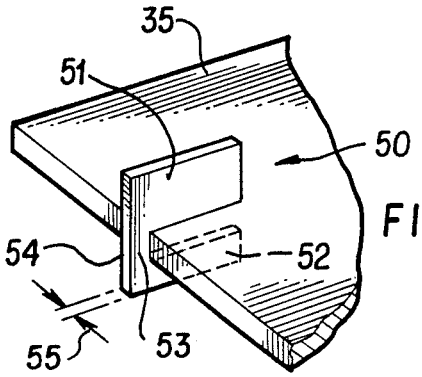
FIG. 5

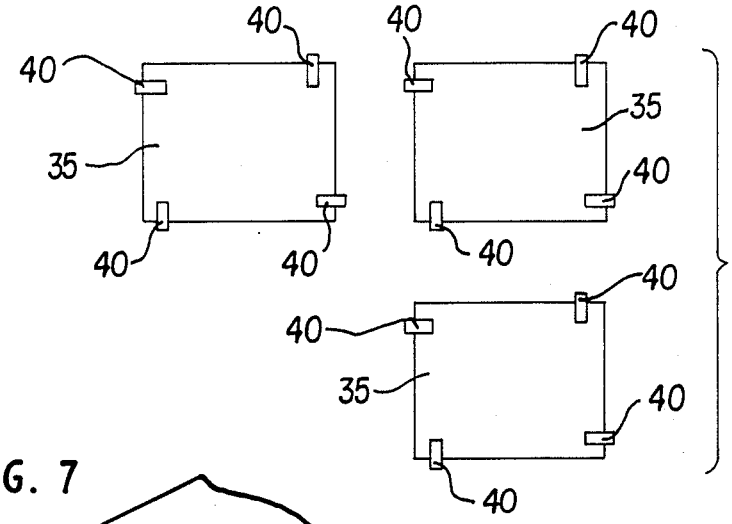
FIG. 6
FIG. 7
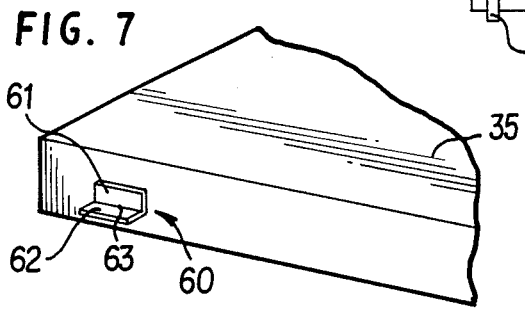
FIG. 8
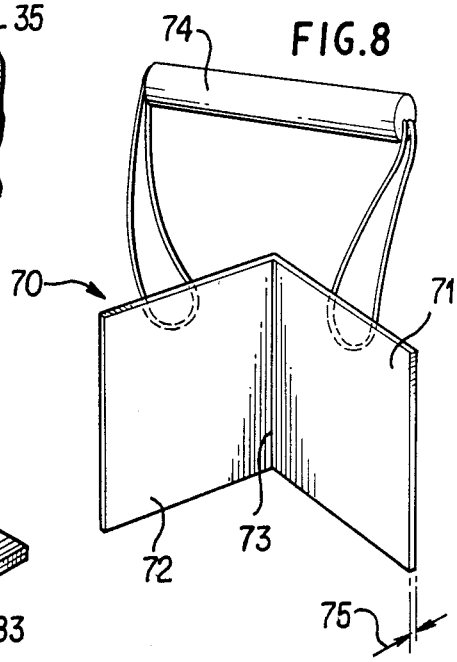
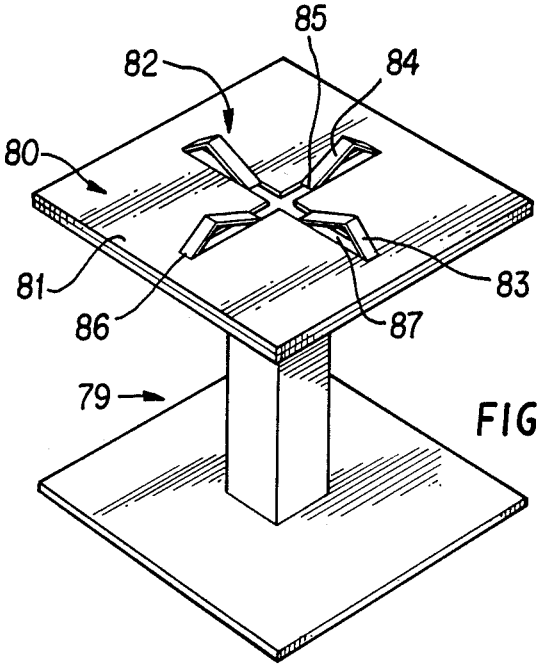
FIG. 9

SELF-GRIDDING FLOORING SYSTEM

BACKGROUND OF THE INVENTION

1. Field of the Invention

This invention pertains to a flooring system and in particular to a flooring system having removable and replaceable flooring panels, such a system commonly being called an access floor.

2. Discussion of the Background

One of the advantages of access floors is that the panels are removable, either singly or in groups. Because such floors are typically manufactured of prefabricated, mass-produced panels, it is desirable that any one or more of the panels be replaceable by any other panel of the same type (i.e., by any geometrically similar panel), whether or not the replacement panel was originally a part of the access floor and whether or not the replacement panel was manufactured in the same lot as the original panels.

For example, it is desirable to be able to replace a damaged panel with a more recently manufactured panel. Also, whenever several adjacent panels of the same nominal size have been removed simultaneously, it is desirable for ease of replacement that these panels be replaceable in an arbitrary configuration according to which it is not necessary to replace each panel in the precise location from which it was removed. Similarly, it is desirable to be able to replace a large number of original panels with replacement panels that are not original.

As a natural consequence of manufacturing, a typical group of flooring panels might be manufactured to a particular set of nominal dimensions, but the actual dimensions of each individual panel will vary within ranges of manufacturing tolerance. Such a variation in actual dimensions will be present among the panels of an access floor when it is initially installed. Replacement panels, such as those purchased later from the same manufacturer, also will exhibit ranges of tolerance about the nominal dimensions.

In recognition of such dimensional variations and the desirability of the interchangeability of panels, it has been the practice in the industry to install an access floor in two steps. The first step involves laying out a gridding on the sub-floor to be covered. The gridding is typically established by making measurements along the floor and placing marks on the floor to establish a system of points and lines designating where the panels will be placed. The second step in installing the access floor is the step of actually placing the panels in their final locations, together with any pedestals on which the panels are to rest.

The gridding, laid out in advance, typically is based upon the worst-case assumption that every panel that will be installed initially has actual dimensions at the maximum negative values of the manufacturing tolerances, and that every replacement panel that may later be installed will have actual dimensions at the maximum positive values of the tolerance ranges. When the actual flooring panels are installed according to this gridding, there typically will be gaps between adjacent panels, and the size of the gap will vary with the actual dimensions of contiguous panels, as installed.

It is widely recognized that such gaps between panels should be minimized to the extent that it is possible to do so and still allow for interchangeability of the panels. However, within the scope of this teaching, some desire to provide a minimum possible gap between panels of essentially zero while others prefer to have a guaranteed finite gap of, for example, about 0.010 inches. The reason that some desire to have a guaranteed minimum non-zero gap is that panels which touch each other can produce squeaking when someone walks across the floor. Such a minimum possible gap, whether essentially zero or some predetermined finite value, may be thought of as a minimum desired gap, depending upon preference.

SUMMARY OF THE INVENTION

One object of the current invention is to provide a self-gridding flooring system that may be installed without laying-out a gridding in advance of the installation of the panels.

It is another object of the current invention to provide a self-gridding flooring system for assuring that the installed panels are sufficiently spaced apart that any one of the panels may be removed and replaced by any geometrically similar replacement panel having the same nominal dimensions and the same tolerance ranges as the original panels without interference between the replacement panel and the panels contiguous thereto.

It is an additional object of the current invention to provide a self-gridding flooring system assuring that such replacement may be achieved more than once at the same location It is a further object of the current invention to provide a self-gridding flooring system comprising a plurality of flooring panels adapted to be contiguously installed above a sub-floor, the plurality of panels having nominal dimensions, individual panels of said plurality having actual dimensions falling within ranges of tolerance with respect to the nominal dimensions, and gridding members for contacting and spacing the panels from one another during installation of the panels above a sub-floor, the gridding members comprising means for gridding the flooring system and for assuring that the installed panels are sufficiently spaced apart that any one of said panels may be removed and replaced by any geometrically similar replacement panel having the same nominal dimensions and the same tolerance ranges without interference between the placement panel and the panels contiguous thereto.

It is yet a further object of the current invention to provide a more efficient process of gridding and installing a flooring system above a sub-floor in such a manner so as to assure that the spacing of a panel from all contiguous panels is sufficient that the panel may be removed and replaced by any replacement panel having the same nominal dimensions as the original panel and the same tolerance ranges without interference between the replacement panel and the contiguous panels.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a perspective view of a conventional flat rectangular flooring panel suitable for use in the current invention;

FIG. 2 is a perspective view of a triangular flooring panel having legs, suitable for use in the current invention;

FIG. 3 shows a configuration of flooring panels, the configuration being provided for purposes of teaching and illustration, and not representing an embodiment according to the current invention;

FIG. 4 is a perspective view, partly broken away, showing a first embodiment of a gridding member according to the current invention in the form of a spacer mounted at the side of a flat rectangular panel;

FIG. 5 is a perspective view, partly broken away, of a second embodiment of a gridding member according to the current invention in the form of a second embodiment of a spacer mounted at the side of a flat rectangular panel;

FIG. 6 is a top view of three contiguous panels bearing spacers according to either of FIGS. 4 or 5, the panels being shown artificially spaced apart for purposes of illustration;

FIG. 7 is a perspective view, partly broken away, of a third embodiment of a gridding member according to the current invention in the form of a third embodiment of a spacer extending from and fixed on a side of a flat rectangular panel;

FIG. 8 is a pictorial view of a fourth embodiment of a gridding member according to the current invention in the form of a fourth embodiment of a spacer;

FIG. 9 is a perspective view of a fifth embodiment of a gridding member according to the current invention in the form of a first embodiment of a gridding pad, the gridding pad being mounted on a conventional pedestal;

DESCRIPTION OF THE PREFERRED EMBODIMENTS

Figure 10:
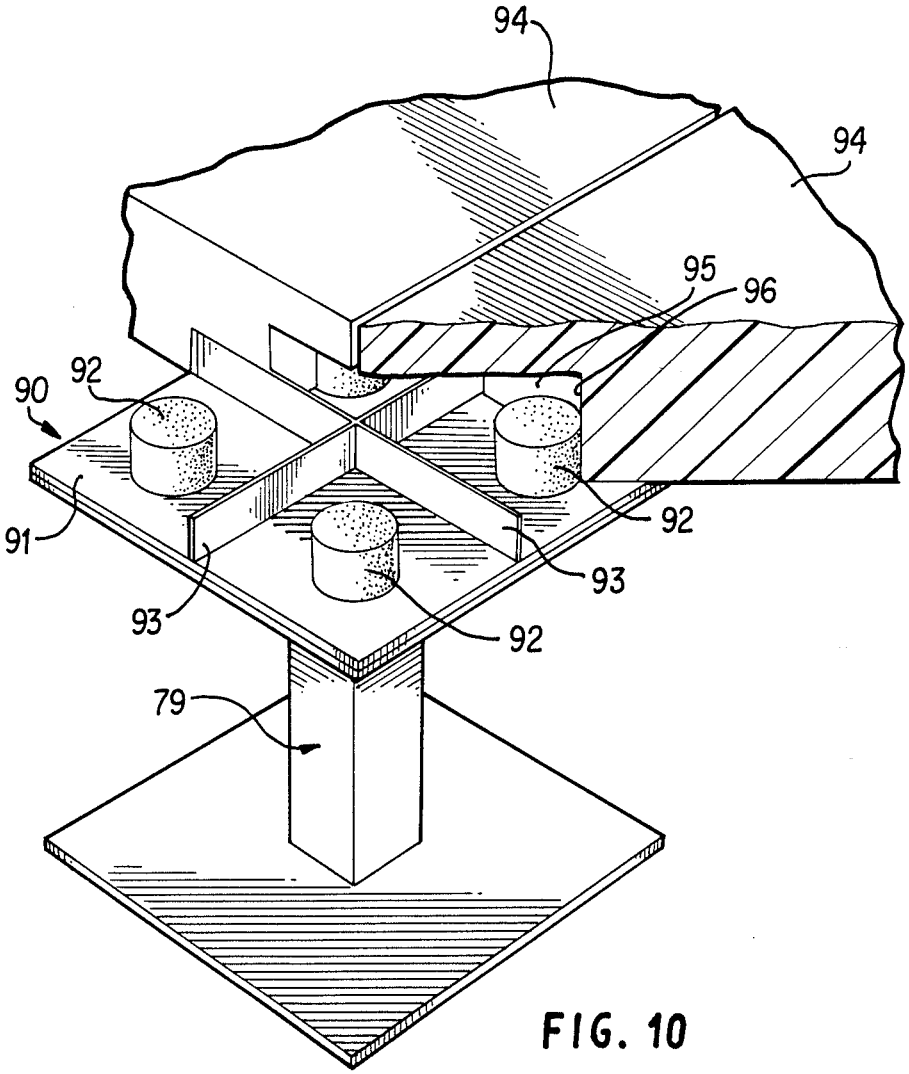
FIG. 10 is a pictorial view, partly in section, showing a sixth embodiment according to the current invention including a second embodiment of a gridding pad, the gridding pad being mounted on a conventional pedestal.

Referring now to the drawings, wherein like reference numerals designate identical or corresponding parts throughout the several views, and more particularly to FIG. 1 thereof, there is shown a conventional rectangular flooring panel 10 having a top surface 12 and sides 16 which meet the top surface 12 along top edges 14. As shown in the drawing, the sides 16 may taper inwardly and downwardly from the to edges 14 such that the usable size and shape of the top surface 12 is defined by four edges 14, each edge 14 having an actual length L.

FIG. 2 shows a triangular panel 20 having a triangular top surface 22 which meets the sides of the panel along top edges 24. The panel comprises a main portion 26 and legs 28. As shown in the drawing, the sides of the panel may taper inwardly and downwardly from the top edges 24 to the base of the legs such that there is formed a panel having a useful upper surface whose dimensions are defined by the actual lengths L of the top edges 24. A flooring panel having three legs such as the panel 20 has many signficant advantages, as set forth in U.S. patent application Ser. No. 888,878, the disclosure of which is hereby incorporated by reference.

The panels 10 and 20 as shown in FIGS. 1 and 2 are representative of panels that may be used according to the current invention. As will become apparent from the following disclosure, the invention includes flooring systems having panels whose top surfaces have virtually any shape that might be used for flooring panels, whether or not such panels are provided with legs as shown in FIG. 2.

Shown in FIG. 3 is an artificial arrangement of triangular panels provided for the purpose of illustration of certain concepts according to the current invention. There are shown two abutting equilateral triangular panels having actual side dimensions $L_L$ at the positive extreme of the manufacturing tolerance range of the panels. Centered atop each of the larger panels is a smaller equilateral triangular panel having actual side lengths $L_S$ at the negative extreme of the manufacturing tolerance range of the panels. Shown in phantom are lines having lengths LN, which represents the position that would be occupied by an equilateral triangular panel having actual side lengths of nominal dimension.

As may be seen from FIG. 3, the edges of the larger panel lie laterally outward beyond the edges of the smaller panel by a horizontal distance e. Because the panels are not rectangular, the numerical value of e is not equal to the numerical difference between LL and $L_S$, nor is it is equal to the difference between $L_N$ and $L_S$. The value of $2e$ is established by the manufacturing tolerances to which the panels were made.

It may be seen from a consideration of FIG. 3 that, in a typical case, the panels must be initially installed such that they are spaced by a distance of at least $2e$ in order to assure that the installed panels are sufficiently spaced apart that any two of the panels may be removed and replaced by any geometrically similar replacement panels having the same nominal dimensions and the same tolerance ranges without interference between the replacement panels and the remaining contiguous panels. This necessity results from the fact that the actual dimensions of the panels typically are not known during initial installation of the floor. Accordingly, it must be assumed that a worst-case situation exists in which each of the initially-installed panels has actual dimensions at the negative extreme of the tolerance range. That is, it must be assumed that each of the panels is an undersize panel having actual dimensions at the negative extreme of the manufacturing tolerance range. Such an assumption assures that each of the panels may be replaced by an oversize panel having actual dimensions at the positive extreme of the manufacturing tolerance range, without interference. If it is desired that a guaranteed minimum gap shall always exist between panels, then the panels will be spaced, upon initial installation, by a distance equal to the sum of this desired minimum gap and *2e*.

The current invention provides gridding members for accomplishing the above-described spacing. The gridding members contact and space the panels from one another during installation of the panels above a subfloor. In certain embodiments, the gridding members also are used during replacement. The gridding members establish not only the location of a panel being installed with reference to the location of previously-installed panels, but also the spacing of the panel being installed from the previously-installed panels. Acocrdingly, the gridding members establish the actual gridding of the flooring system as it is being installed and assure that the installed panels are sufficiently spaced apart that any one of said panels may be removed and replaced by any geometrically similar replacement panel having the same nominal dimensions and the same tolerance ranges without interference between the replacement panel and the panels contiguous thereto. It should be noted that, since the gridding is established by contact between a panel being installed and a previous panel, the actual gridding ultimately established for the flooring system as a whole will typically be irregular and therefore will differ from the gridding established according to the prior art process in which a geometrically regular pattern is established in advance before the panels are installed.

There follows a description of certain terms which are used throughout the specification and claims, which terms may now be better understood by reference to the foregoing discussion.

The "spacing" between adjacent panels is measured at the point or points of minimum spacing between two installed contiguous panels. For example, if panels have sides tapering inwardly from the top surface, the spacing is measured between the edges of the panels at the top surfaces. In considering the spacing between panels, any gridding member according to the current invention that may be present is ignored.

The term "gridding member" includes a gridding pad, examples of which are described herein, and a simple spacer, examples of which are described herein.

The "minimum desired gap" is the smallest spacing that will ever exist between two contiguous panels under a worst-case condition. The size of the minimum desired gap is a matter of choice. It may be zero or greater than zero "Interference" is that phenomenon which occurs when previously-installed panels contact a replacement panel which is being installed in such a manner that it is not possible to install the replacement panel fully without either repositioning at least one of the installed panels or deforming either an installed panel or the replacement panel. Two contiguous panels may contact each other slightly without producing interference.

"Interchangeability" has been achieved when it is assured that the installed panels are sufficiently spaced apart that any one of the panels may be removed and replaced by any geometically similar replacement panel having the same nominal dimensions and the same tolerance ranges without interference between the replacement panel and the panels contiguous thereto Interchangeability has been achieved if it is assured that such replacement may be carried out at least one time. Repeatable interchangeability is achieved when it is assured that such replacement may be carried out an indefinitely great number of times.

An "oversize panel" is a panel having at least one side length dimension that is greater than nominal.

An "undersize panel" is one having at least one side length dimension that is less than nominal.

The word "comprising" means "having at least."

Turning now to FIG. 4, there is shown a gridding member in the form of a first embodiment of a spacer 40. The spacer 40 is shown mounted on a conventional flat panel, but it also is suitable for use with a panel having legs. In the case in which the panel is not provided with legs, it may be used with any conventional pedestal, provided that the pedestal does not interfere either with the initial establishment of the gridding or with replacement of the originally-installed panel by a replacement panel.

The spacer 40 is in the form of a U-shaped member having an upper leg 41 and a lower leg 42, these two legs being connected at a bight 43, the legs serving as mounting means for mounting the spacer on the panel such that the bight is disposed between the panel and an adjacent panel. Contact surface 44 serves to make contact with a contiguous panel during installation to establish the spacing. At least the bight 43 is made of a frangible material such as a brittle plastic s that the spacer may be broken at the appropriate time. For convenience, the entire spacer may be made of such frangible material. An optional stress raiser is provided in the form of a notch 45 for facilitating breakage. The spacer extends laterally from the side of the panel by a distance such that a spacing of *2e* will be provided between contiguous panels upon contact between contact surface 44 and a contiguous panel. If the minimum desired gap is greater than zero, the distance that the spacer extends laterally from the side of the panel will be made greater than *2e* by a distance equal to the minimum desired gap.

FIG. 5 shows a second embodiment of a spacer in the form of a spacer 50 having upper and lower legs 51, 52, respectively, the legs being connected by a bight 53. As in the embodiment of FIG. 4, there is provided a contact surface 54 for contacting a contiguous panel. The spacer extends laterally outward from the side of the panel by a distance of at least *2e*. Such distance, in the embodiment of FIG. 5, is no less than the transverse thickness 55 of the bight 53 and of the lower leg 52.

FIG. 6 is a top view showing one example of how the spacers of either FIG. 4 or FIG. 5 may be used to provide the desired gridding installation of a flooring system.

There are shown three panels 35, each side of each panel being provided with a spacer 40. Spacers 50 may be used in the alternative.

The panels are shown artificially spaced apart, as for example just before the completion of installation. It may be seen that the desired spacing of *2e* (or of *2e* plus a minimum desired gap) will be achieved when the panels are moved together such that a spacer mounted on one panel will contact an adjacent panel. Accuracy in achieving the desired positioning and spacing of the panels is increased by displacing the spacers toward the edges of their respective sides so that two spaced points of contact will be provided for each pair of contiguous panels.

If desired, the number of spacers used may be cut in half by using only one spacer between each pair of contiguous panels. In such a case, the spacer may be disposed approximately half way along the length of the side of the panel.

Following installation using either of the embodiments of FIGS. 4 and 5, there will be present an undesirable protrusion above the top surfaces of the panels caused by the presence of the upper legs 41, 51, respectively. Therefore, it is desirable to remove these spacers following installation. In the case of FIG. 4, such removal is accomplished by destroying the spacer by breakage, as noted above. The upper leg 41 is then discarded, and the bight 43 and lower leg 42 fall harmlessly to the sub-floor. In the case of FIG. 5, the thickness 55 is such that the spacer may be turned sideways and lifted upwardly through the gap between contiguous panels.

Even though the spacers may have been removed, the gridding remains such that interchangeability is assured. However, if several adjacent panels are removed and replaced more than one time, the gridding may gradually deteriorate and be lost. However, repeatable interchangeability may be achieved if the spacers are used not only upon initial installation of the floor but also upon every occasion in which a replacement panel is inserted or in which an original panel is re-inserted.

Shown in FIG. 7 is a third embodiment of a spacer according to the current invention. The spacer 60 extends from and is fixed on a side of a panel 35. Spacer 60 is formed by bending to form a first leg 61 fixed on the panel, as by an adhesive, and a second leg 62 extending outwardly from the first leg 61 and joined thereto by hinge 63. The spacer 60 functions in a manner generally analogous to that of the embodiments of FIG. 4 and 5, except that it is designed to remain in place after initial installation and is therefore capable of achieving repeatable interchangeability. Upon initial installation of the floor, the initial spacing between the panels will be determined by the length of the second leg 62, as measured outwardly from the side of the panel 35. The actual length of the leg 62 will depend upon whether or not the sides of the panels are tapered and also upon the dimension of the minimum desired gap.

The hinge 63 should be sufficiently flexible to allow the second leg 62 to bend upwardly or downwardly, as needed. In particular, if the panel 35 as shown in FIG. 7 represents a panel in a completed installation, and if it is desired to replace the contiguous panel whose position has been determined by the spacer 60, and if the replacement panel is larger than the original panel, then the larger replacement panel will bend the second leg 62 downwardly in order to accommodate the increased size of the replacement panel. On the other hand, if the panel 35 illustrated in FIG. 7 represents a replacement panel, and if that replacement panel is larger than the panel it is replacing, the second leg 62 will be bent upwardly by a contiguous panel that is already in place.

Variations of the structure of the embodiments shown in FIG. 7 are possible. For example, as an alternative to bending at hinge 63, the spacer 60 may be attached to panel 35 using an adhesive that is weak in shear so that the spacer 60 may be knocked off when desired. Such knocking-off would be equivalent to spacer destruction or removal as described with respect to FIGS. 4 and 5. As a different variation, and depending upon the structure and materials of the panel 35, it may be possible to form the spacer 60 by cutting the second leg 62 from the material of the panel and bending it outwardly along the hinge 63 such that the spacer extends from and is fixed on a side of the panel.

In each of the embodiments described above, a plurality of spacers are used to grid the flooring system. It is possible but less convenient to grid an entire flooring system by repeated use of only a single spacer such as spacer 70 shown in FIG. 8. The spacer includes first and second legs 71, 72, respectively, which meet along line 73 at an angle determined by the angles at which the sides of a panel meet. Thus, if the panels of the flooring system are rectangular, the legs 71, 72 meet at an angle of ninety degrees. If the panels of the flooring system are equilateral triangles, the legs 71, 72 meet at an angle of 60°.

The height and length of each leg 71, 72 is arbitrary. The thickness 75 is substantially equal to *2e* for a minimum desired gap of zero. If a greater minimum desired gap is to be provided, the thickness 75 will equal to the sum of the minimum desired gap and *2e*.

During initial installation, the spacer 70 is placed sequentially first at one and then at another corner of a panel being installed to provide proper spacing from the already-installed contiguous panels and to space later-installed panels. For this purpose, optional handle 74 may be provided for ease in handling the spacer.

In the above-described embodiments, the gridding member takes the form of a spacer. In the following embodiments, the gridding member is in the form of a gridding pad comprising a base for supporting corner portions of a plurality of contiguously-installed panels and further comprising a plurality of contacting means in the form of upstanding members for contacting the panels during the installation thereof to establish the desired gridding.

A first embodiment of a gridding pad according to the current invention is shown in FIG. 9. Gridding pad 80 is shown fixed on a conventional pedestal 79, the details of which form no part of the current invention. If desired, the height of pedestal 79 may be adjustable, as by screw threads provided therein.

Gridding pad 80 includes a base 81 and a plurality of upstanding members 82. In the illustrated embodiment, the gridding pad 80 is designed for use with rectangular shaped panels. Accordingly, there are four upstanding members 82, each one oriented at 90° with respect to its neighbor.

Gridding pad 80 may conveniently be formed by a punching operation carried out on a piece of sheet metal. Each upstanding member 82 includes a hinged portion 83 hingedly connected to the base at 86 and extending upwardly at an acute angle. To provide for enhanced lateral strength and ease of use, it is desirable that each upstanding member further include an extension 84 formed by bending the hinged portion 83. Each extension 84 terminates in a free end 85. It may be seen that each upstanding member 82 is formed by bending material which was taken from the original material of the base such that there are formed gaps 87 in the base through which the top of the pedestal is visible in the figure.

In use, the gridding during initial installation is established by lateral contact between the side edges of the upstanding members and the sides of the panels.

The width of each upstanding member (i.e, as measured along the length of the hinge 86) is chosen so as to establish the desired spacing between panels, such as a spacing of *2e* or a spacing of *2e* plus the size of the minimum desired gap. In the simplist case in which the sides of the panels are vertical, the width of the upstanding members will equal the spacing of the panels. However, if the sides of the panels are tapered and if the height t which the upstanding members 82 rise above the level of the base 81 is less than the height of the panels, then the width of the upstanding members 82 will be greater than the panel spacing. Accordingly, the actual dimensions are a matter of choice for the designer of the system.

It may be seen, by virtue of the hinged connection 86, the free end 85 and the gaps 87, that the upstanding members are movable to the base 81 and, in fact, may be received in the recess formed in the base by the gaps 87. In this way, the gridding pad 80 accommodates the possible future installation of a panel or panels that are larger than those originally installed. In particular, if an original panel is replaced by a larger one, the larger replacement panel may be installed using a substantially vertical motion such that it contacts the upstanding members 82 and pushes them to the base 80 so that they are received in the recesses 87. In this way, interchangeability is assured.

It is not necessary for the upstanding members 82 to be resiliently mounted on the base 81 such that they spring back into position if the oversized replacement panel is ever removed. However, it is desirable for the upstanding members 82 to be at least manually liftable for future spacing purposes if it should ever be desired to replace the oversized panel with a third panel in the same location which happens to be smaller than the oversized replacement panel. Repeated interchangeability may thereby be assured.

Variations of gridding pad 80 as illustrated in FIG. 9 are possible. For example, the number of upstanding members 82 and the angles between adjacent upstanding members 82 may be altered to accommodate triangular panels or panels of other shapes. In addition, gridding pad 80 may be used with panels having legs by making only slight dimensional variations to accommodate the increased taper resulting from the presence of the legs. In such a case, it may be desirable to omit the pedestal 79 and rest the gridding pad 80 directly on the sub-floor. In any case it is desirable for the gridding pad 80 to be fixed in place, as by adhesive, either on the pedestal 79 or directly on the sub-floor so as to preserve the original gridding, once it is established. If the pad is not adhesively fixed in place, the gridding may be lost if several adjacent panels are removed simultaneously, and it may then become necessary to re-grid a large are of the sub-floor.

FIG. 10 shows a second embodiment of a gridding pad according to the current invention. The gridding pad 90 comprises a base 91 and a plurality of upstanding members 92 formed of a crushable material such as a tightly-compacted powder. There is an opening formed in each of the panels at a location directly above the gridding pad. The upstanding members 92 extend into these openings. In the illustrated embodiment, the opening is formed by lateral walls 95, 96 which extend inwardly from respective sides of the panel and meet at an angle. During installation, the panels are moved sideways until the round upstanding members rest in the angle formed by the meeting of the surfaces 95, 96. This action locates the panels to provide the desired spacing.

After original installation, if a panel is replaced by a larger panel such that the walls 95, 96 lie closer to the center of the gridding pad 90 than upon original installation, then the upstanding members 92 may be crushed by the descending bottom surface of the replacement panel during installation. On the other hand, if the replacement panel is smaller than the original panel, no such crushing is necessary and the upstanding members will be received at any location within the opening in the panel. In this manner, interchangeability is assured.

If desired, gridding pad 90 may be provided with flanges 93 extending upwardly from the base 91 between the panels. Flanges 93 typically do not contact the sides of the panels during original installation and, accordingly, they typically have no effect upon the original establishment of the gridding. However, if at any time during the life of the flooring system one or more of the upstanding members 91 is crushed, the flanges 93 are then available for providing the limits of locations for future replacement panels. In this way, repeatable interchangeability may be assured.

In the illustrated embodiment, the openings in the bottoms of the panels extend all the way from the walls 95, 96 to the corner of the panel. It is not necessary that the openings be this large. Nor is it necessary that the openings extend all the way to the sides of the panels. However, it is desirable that the opening be larger than the upstanding member 92 so as to minimize the number of occasions on which crushing of the member 92 will occur.

In the illustrated embodiment, the upstanding members 92 are shown as cylindrical. Other geometries are possible. In addition, it is not necessary that the walls 95, 96 be flat. It is necessary only that the cooperation between the upstanding members and the panel be such that the panel may be located and gridding established.

Figure 11:
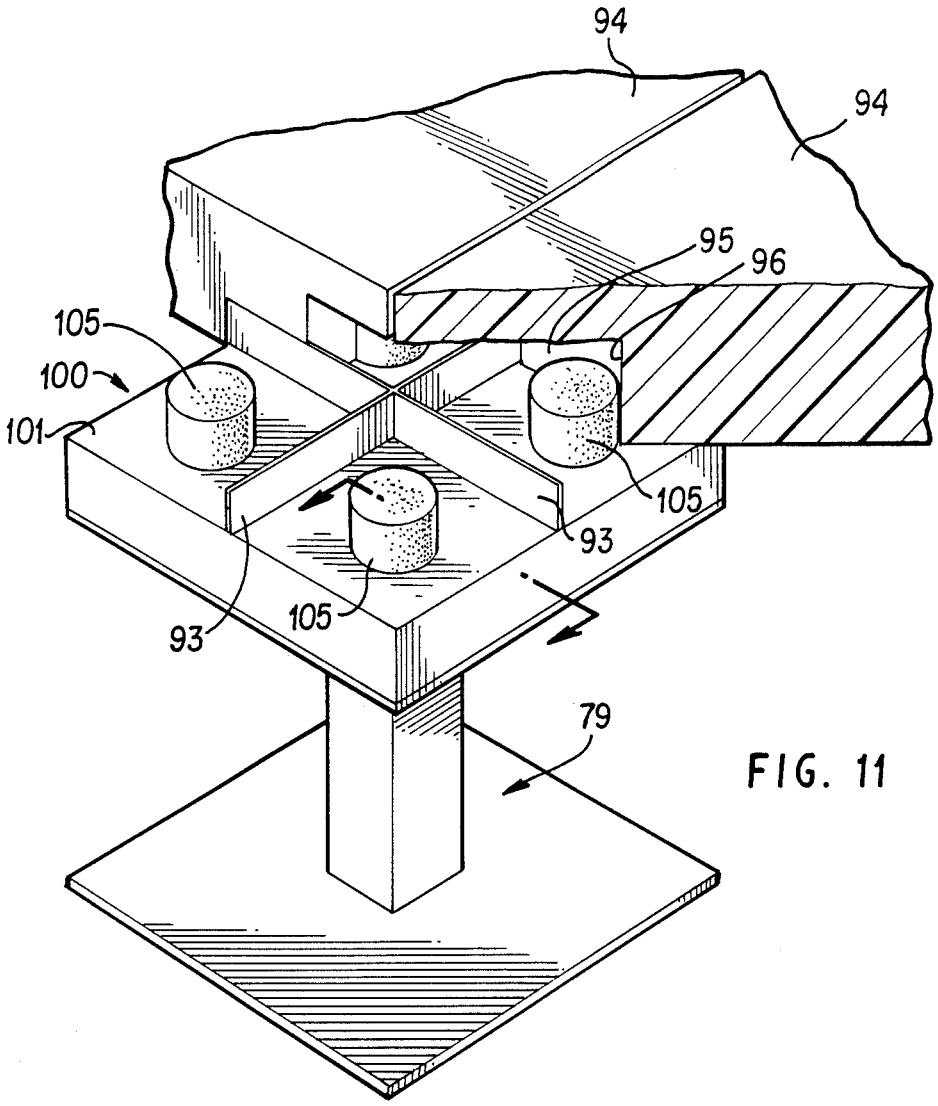
FIG. 11 is a pictorial view, partly in section, illustrating a seventh embodiment according to the current invention including a third embodiment of a gridding pad, the gridding pad being mounted on a conventional pedestal.
Figure 12:
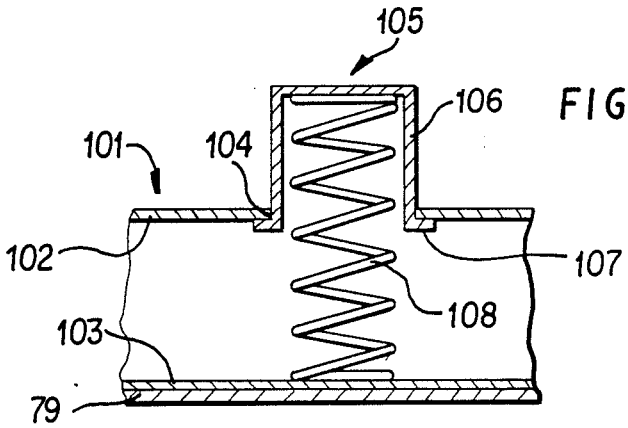
FIG. 12 is an elevational cross-section taken on line XII—XII of FIG. 11.

As was the case with the embodiment of FIG. 9, the embodiment of FIG. 10 may be altered to accommodate panels of any shape and to accommodate panels having legs FIGS. 11 and 12 illustrate a third embodiment of a gridding pad according to the current invention. There is provided a gridding pad 100 comprising a base 101 and a plurality of upstanding members 105. The base 101 includes an upper member 102 and a lower member 103. Each raised member 105 is movably mounted in an opening 104 in the upper member 102 of the base. It may be seen that this embodiment functions similarly to the embodiment of FIG. 10, except that the upstanding member 105 recesses into the opening 104 instead of being crushed. Spring 108 provided in base 101 biases the upstanding member upwardly, while flange 107 provided at the bottom of sidewall 106 of the upstanding member retains the member in place in the base against the bias of the spring.

In most other respects, this embodiment is structurally like that of the embodiment of FIG. 10. However, because the upstanding members 105 may be reused after once having been pushed into the base by the installation of an oversize panel, it is not necessary to rely on the flanges 93 in order to achieve repeatable interchangeability. However, it may nevertheless be desirable to provide such flanges 93 to aid in the prevention of rubbing of one panel against another should the situation ever arise in which two maximum oversize replacement panels are installed adjacent each other. Such rubbing can cause undesirable squeaking.

Figure 13:
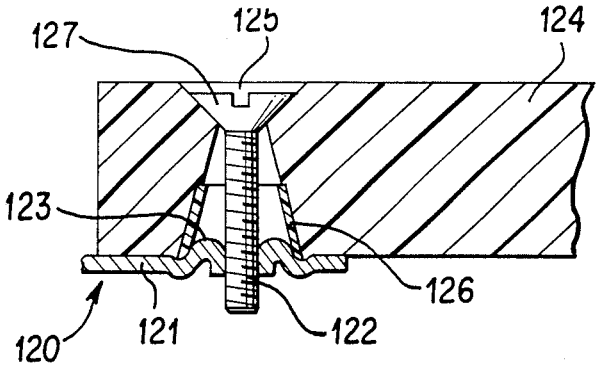
FIG. 13 is an elevational cross-section illustrating an eighth embodiment according to the current invention including a fourth embodiment of a gridding pad.

Upon occasion it is desired that flooring panels be screwed or bolted to their pedestals. FIG. 13 illustrates such a further embodiment according to the current invention. Panel 124 is provided with an opening in the form of a through-hole 125 for receiving a threaded fastener 127. Deformable bushing 126 is disposed in the opening 125. The deformable bushing may be made of a resilient material which is rubber, but it is not necessay for the material of the bushing 126 t be resilient.

The panel 124 rests on a gridding pad 120, only a portion of which is shown. The gridding pad 120 comprises a base 121, a plurality of openings 122 corresponding to the number of threaded fasteners and panels to be supported on the gridding pad. There is provided an upstanding member 123 extending circumferentially of each opening 122. The deformable bushing 126 receives the upstanding member 123 and establishes the initial spacing of panels by contact between the deformable bushing 126 and the upstanding member 123.

Upon replacement of the original panel 124 with a replacement panel having different actual dimensions, the dimensional variation is accommodatd by deformation in the bushing 126 as it presses against the upstanding member 123.

During initial installation, the self-tapping threaded fastener 127 will cut threads in the base 121 along the opening 122. Upon replacement, the deformable bushing allows a dimensionally different panel to be attached, assuming normal thread clearances. The bolt may tighten at an angle other than vertical.

Figure 14:
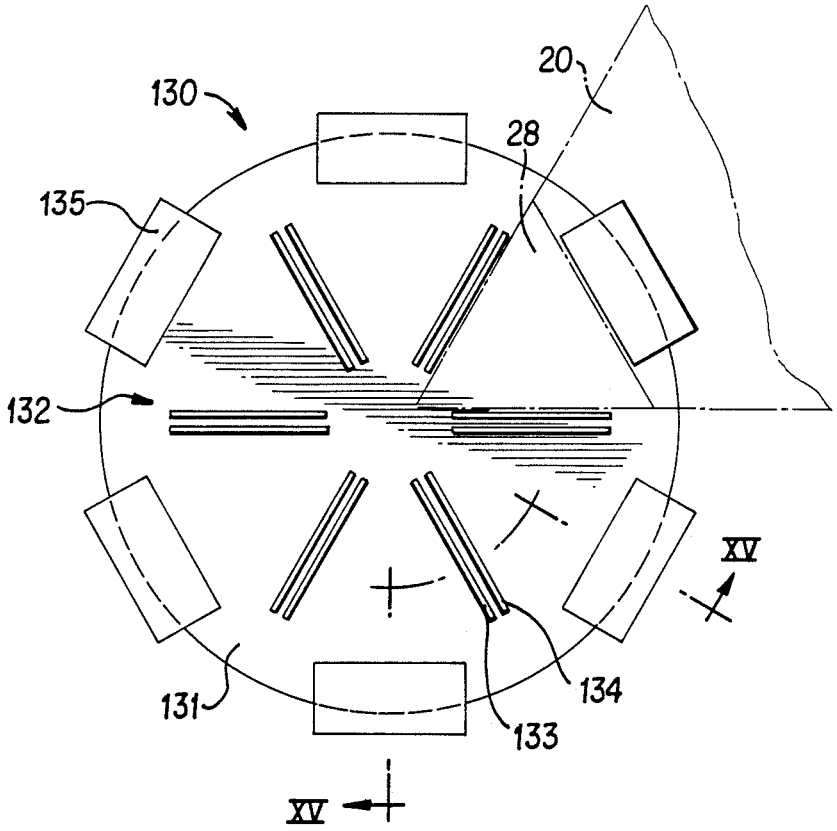
FIG. 14 is a top view illustrating a ninth embodiment according to the current invention including a fifth embodiment of a gridding pad, there being shown in phantom a portion of a panel and a leg of that panel.
Figure 15:
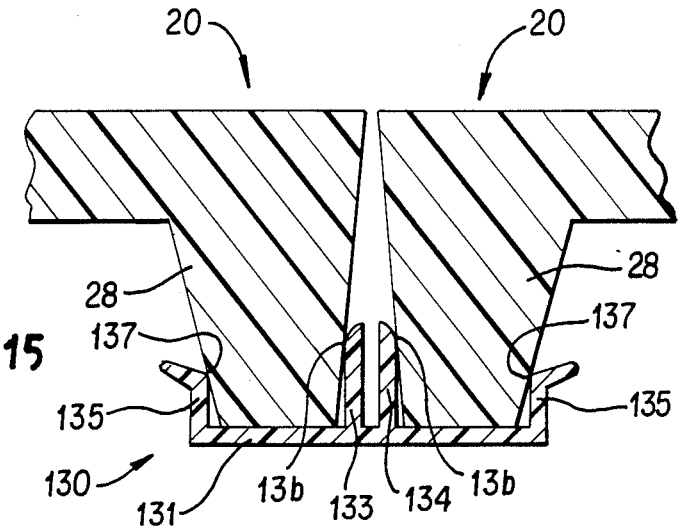
FIG. 15 is an elevational cross-section taken on line XV—XV of FIG. 14, also showing legs of two contiguous panels in place.

FIGS. 14 and 15 show a fifth embodiment of a gridding pad according to the current invention which is especially adapted for use with panels 20 having legs 28. One such panel 20 is shown in phantom in FIG. 14, with a cross-section of a leg 28 being taken at an arbitrary point between the bottom of the leg and the points of contact 136, 137 discussed below. Two contiguous panels are shown in installed position in FIG. 15.

Each gridding pad 130 comprises a base 131 and a plurality of pairs 132 of upstanding members, there being a first upstanding member 133 and a second upstanding member 134 in each of the pairs. The pairs are disposed between contiguous panels for laterally contacting the panels.

The gridding pad 130 further comprises a plurality of retainers 135, each retainer lying underneath the main portion 26 of a panel for contacting the leg 28 of the panel from behind.

Due to the taper in the sides of the panels, the upstanding members 133, 134 contact the sides at points 136 which are spaced above the base 131 of the gridding pad. Similarly, the retainers 135 make contact at points 137 which also are spaced above the base 131.

During initial installation of the floor, the gridding pads 130 are mounted with a slow-setting adhesive of a kind commonly used in the art. Such an adhesive allows for some movement of the gridding pad during installation, as subsequent panels are installed and pull the pad in a particular direction. However, after initial installation, the gridding pad absorbs the forces generated by installation of replacement undersize and oversize panels.

In particular, the upstanding members 133, 134 are configured to provide for the movement of at least a portion of one of the members toward the other when forced by contact with the sides of a larger replacement panel. Such movement may be provided for by selection of the material of the gridding pad, selection of the thickness of the upstanding members 133, 134, by any special configuration of the manner in which the upstanding members are mounted to the base, or by any other factor. In a preferred form, the gridding pad is made of nylon, and each upstanding member has a thickness of about 0.085 inch.

It is not necessary that the movement of the upstanding members be either resilient or elastic. Even if plastic deformation of one or more of the upstanding members 133, 134 or of the retainer 135 occurs, repeatable interchangeability is assured because these members remain in place in their deformed states. Therefore, they form an outer boundary or envelope within a which a replacement panel will fit.

With reference to FIG. 15, it may be seen that if one or both of the panels is replaced by a larger panel, one or both of the members 133, 134 will be forced toward the other, thereby accommodating the increased size of the replacement panel. Because of the taper in the side of the panel extending all the way to the base of the leg, there is upon initial installation a space between the side of the panel at the base of the leg and the adjacent respective upstanding member 133 or 134. Accordingly, there is sufficient room adjacent the lowermost portion of each upstanding member 133, 134 for accommodating the larger size of a larger replacement panel.

On the other hand, it may be seen that if one or both of the panels is replaced by a smaller panel, the retainer 135 may deform to accommodate the smaller panel. Furthermore, the retainer 135 will cooperate with the retainers 135 of the other gridding pads that support the remaining legs of the replacement panel, thereby helping to center the replacement panel. It should be noted that such centering, although desirable, is not necessary for assuring repeatable interchangeability.

Figure 16:
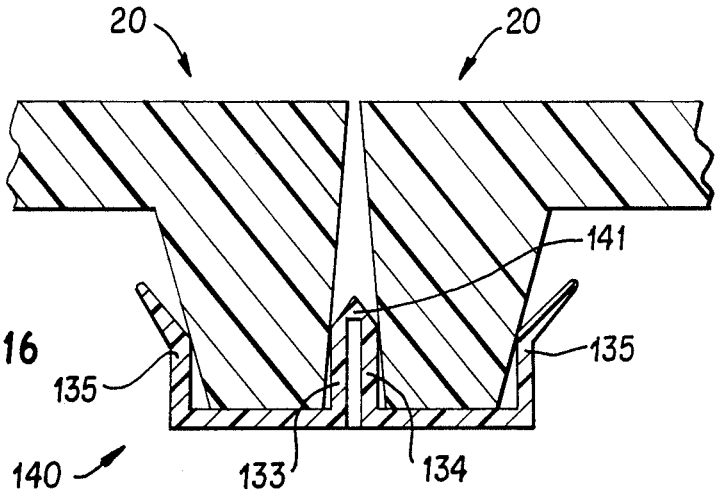
FIG. 16 is an elevational cross-section similar to that of FIG. 15 but illustrating a tenth embodiment according to the current invention including a sixth embodiment of a gridding pad.

It may now be seen that it is desirable for the upstanding members 133, 134 to be sufficiently rigid that they do not deform substantially upon the ordinary forces encountered during initial installation of the floor, because such deformation ordinarily is not necessary at that time. On the other hand, they must be able to move toward each other upon replacement of the original panels with larger panels. This desirable characteristic may be enhanced by the provision of a deformable linkage as shown in FIG. 16, which illustrates a sixth embodiment of a gridding pad according to the current invention. Gridding pad 140 in FIG. 16 is like the embodiment shown in FIG. 15 with the addition of deformable linkage 141 joining the first and second upstanding members 133, 134. Deformable linkage 141 resists but does not prevent the movement of one upstanding member toward the other.

Figure 17:
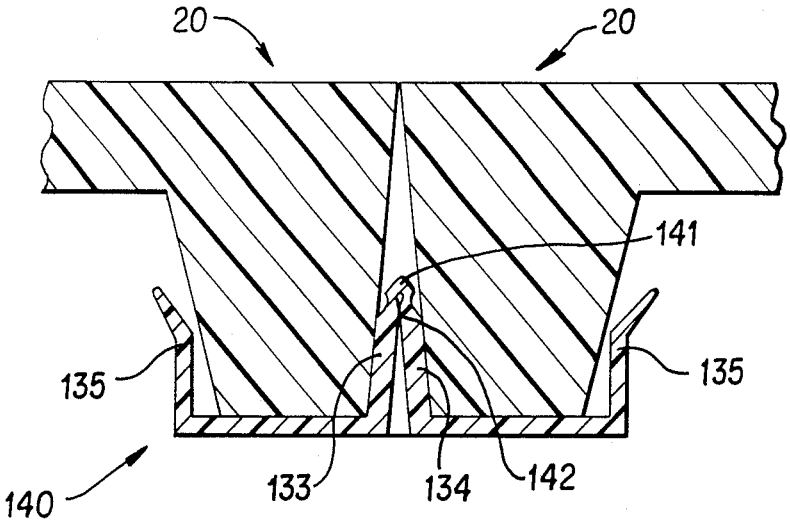
FIG. 17 is an elevational cross-section illustrating the embodiment of FIG. 16 in a different state and, in particular, following the replacement of two originally contiguous panels of smaller actual dimension with two contiguous panels of maximum actual dimensions.

FIG. 17 shows the gridding pad 140 of FIG. 16 in a different state. In particular, there is shown the condition in which both original contiguous panels have been replaced with larger panels having dimensions at the positive extremes of the manufacturing tolerance. That is, the panels shown in FIG. 17 are the largest that must ever be accommodated by the flooring system. It may be seen that the deformable linkage 141 has deformed upon the movement of each upstanding member 133, 134 toward the other. It may further be seen that the sides of the panels are in face contact with the sides of the upstanding members such that no larger panel may now be accommodated.

If desired, the upstanding members may be configured to provide a physical stop for further limiting the extent of movement of one of the upstanding members toward the other. Such physical stop is illustrated by the contact between the upstanding members 133, 134 shown at point 142. It should be noted that such a physical stop may be provided in the embodiment of FIG. 15 by providing for contact between the upstanding members 133, 134 upon insertion of maximum oversized panels on opposite sides thereof.

Shown in FIGS. 18–21 are two additional and more preferred embodiments of gridding pads according to the current invention for use with panels having legs.

Figure 18:
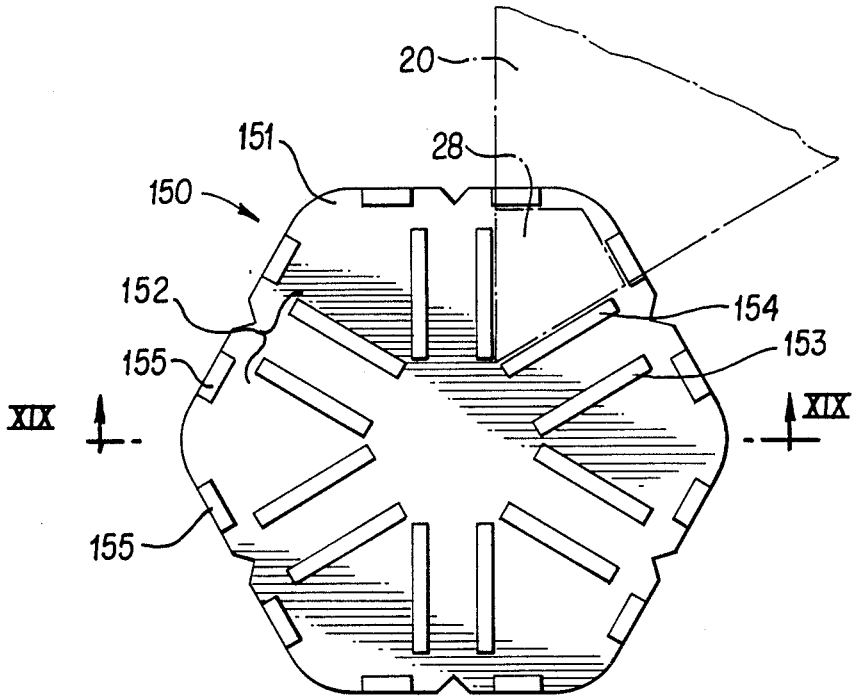
FIG. 18 is a top view illustrating an eleventh embodiment according to the current invention including a seventh embodiment of a gridding pad, also showing in phantom a portion of a panel and a leg of that panel.
Figure 19:
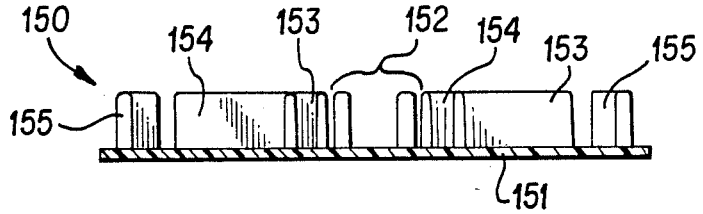
FIG. 19 is a front view taken on line XIX—XIX of FIG. 18.

The embodiment of FIGS. 18 and 19 is similar to that of FIGS. 14 and 15. There is provided a gridding pad 150 having a base 151 and pairs 152 of upstanding members 153, 154. Shown in phantom is a portion of a panel 20 having a leg 28. The shape of the leg 28 is different from that shown in FIG. 14. The leg may desirably be provided with two faces disposed beneath the main portion of the panel for cooperating with two spaced retainers 155 provided for engaging first and second side portions of each leg. Aligning forces within the panel will arise at neighboring gridding pads, and the spaced retainers 155 are oriented substantially normal to the direction in which these aligning forces will act to engage a third side portion of each leg.

The embodiment of FIGS. 18 and 19 further differs from the embodiment of FIGS. 14 and 15 in the spacing apart of the raised members 153, 154 of a pair 152. In particular, these raised members are spaced sufficiently far apart that they will not contact each other upon the insertion of larger replacement panels. Accordingly, the size of the largest replacement panel that may be inserted will be governed by the fact that the largest panel which may be inserted as a replacement panel is one which will achieve face contact between the side of the panel and the face of the upstanding member. In a preferred form, the gridding pad is made of nylon, and each upstanding member has a thickness of about 0.085 inch.

Figure 20:
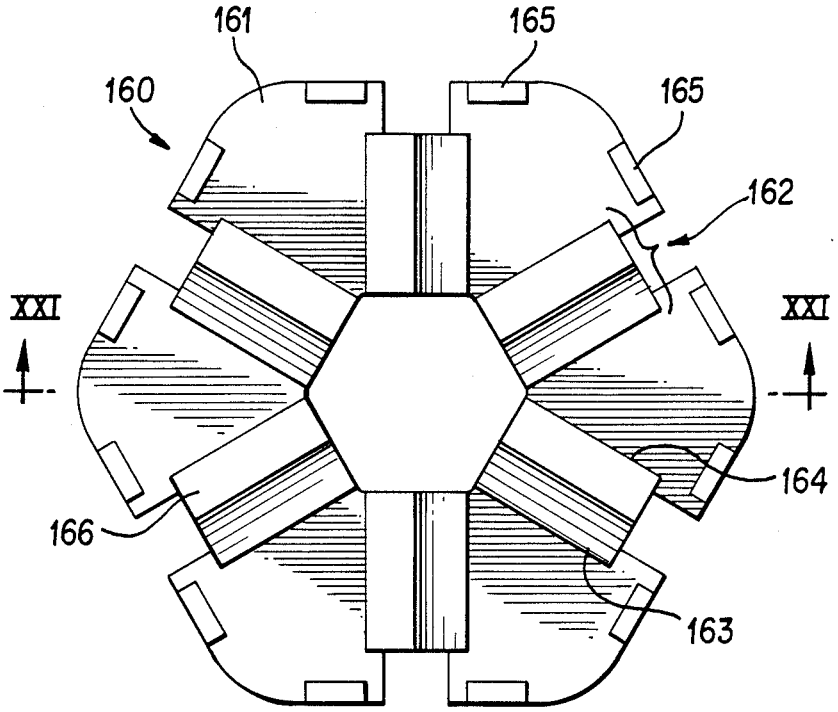
FIG. 20 is a top view illustrating a twelfth embodiment according to the current invention including an eighth embodiment of a gridding pad.
Figure 21:
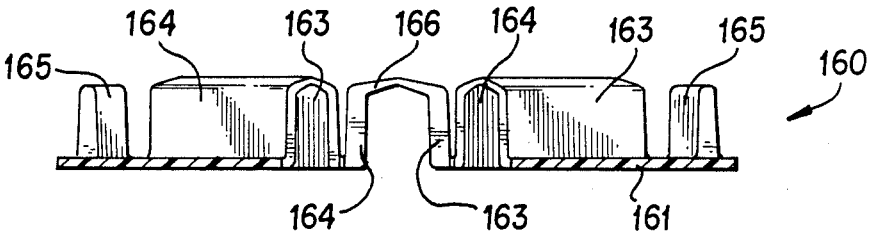
FIG. 21 is a front view taken on line XXI—XXI of FIG. 20.

FIGS. 20 and 21 show an eighth embodiment of a gridding pad according to the current invention which is more preferred than the embodiment of FIGS. 16 and 17. There is provided a gridding pad 160 having a base 161, a plurality of pairs 162 of upstanding members 163, 164 and two retainers 165 for each leg of a panel. There is further provided a deformable linkage 166 joining the first and second upstanding members 163, 164 of each pair 162. The deformable linkage resists but does not prevent movement of at least a portion of one of the upstanding members toward the other. Except for the provision of the deformable linkage 166, the embodiment of FIGS. 20 and 21 is functionally like the embodiment of FIGS. 18 and 19.

The gridding pads of FIGS. 14–21 are illustrated for use with equilateral triangular panels. They may easily be modified for use with other kinds of triangular panels, rectangular panels, or other shapes by modifying the number of pairs of upstanding members, the number of retainers, and the angles between adjacent pairs of upstanding members. Furthermore, panels that do not have legs also may be accommodated by providing openings in the bottoms of the panels to receive the retainers or by omitting the retainers. If the retainers are omitted, these panels will perform in a manner somewhat analogous to that of the embodiment of FIG. 9, except that the upstanding members will bend toward each other instead of recessing into the base. In such a case, the gridding pads of FIGS. 14–21 may be elevated on pedestals.

Shown in FIG. 20 is a top view of a plurality of installed panels at one representative and typical point in time during the initial installation of a flooring system having triangular panels and gridding pads 17014 173. The gridding pads 170–173 are intended to represent any embodiment according to FIGS. 14–21. For purposes of discussion, only four such gridding pads are shown in the drawing, but it will be understood that other gridding pads are present at the vertices of the triangles.

The numbering of the panels 181–189 and 195–198 represents one possible sequence of installation. Numeral 199 represents the location, shown in phantom, of a next panel to be installed. The bottoms of the gridding pads have been provided with adhesive, and it is assumed that the adhesive has not yet set.

Before the installation of panel 198, gridding pads 170–172 already were in place. Gridding pads 171 and 172 were used to establish the location of panel 198 and the spacing of that panel from panel 197. Either during or after the installation of panel 198, gridding pad 173 was placed under the corresponding leg of panel 198. Thereafter, panel 199 is installed by lowering it onto gridding pads 170, 172 and 173. Depending upon the length of the side of panel 199 that is adjacent the panel 185, and also depending upon the original positions of gridding pads 170 and 172, some relative repositioning of gridding pads 170 and 172 may occur at this time by virtue either of a pushing action of the legs of panel 199 against the upstanding members of gridding pads 170, 172 or by virtue of a pulling action of the legs of the panel 199 on the retainers of gridding pads 170, 172. In either event, the gridding pads 170 and 172 establish the location of panel 199, the spacing of panel 199 from panel 185, and the spacing of panel 199 from panel 198. Upon the insertion of panel 199, some repositioning of gridding pad 173 may also occur because of a pushing or pulling of the leg of panel 199 against the upstanding members or the retainer of pad 173.

Figure 22:
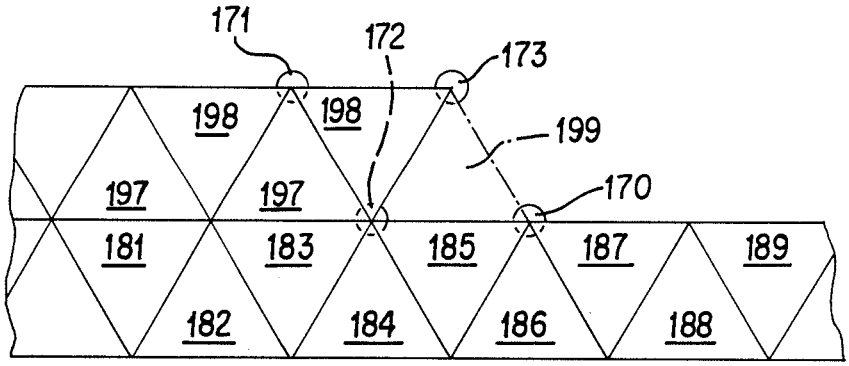
FIG. 22 is a top view showing an intermediate stage of installation of a flooring system according to the current invention.

If FIG. 22 is thought of as representing a flooring system according to the embodiment of FIG. 13, the installation and the results are quite similar except that gridding pad 173 is secured to panel 198 by the threaded fastener before panel 198 is introduced to gridding pads 171 and 172. Because of the circumferential contact between upstanding member 123 and the deformable bushing 126, some repositioning of gridding pads 171 and 172 may occur when panel 198 is bolted to those gridding pads.

If FIG. 22 is thought of representing any of the embodiments of FIGS. 9–12, the explanation is simplified because there arise only very minimal forces that might tend to reposition the gridding pads. Accordingly, the gridding pads remain substantially fixed in position, once placed. Initial installation of a panel becomes a simple matter of sliding the panel substantially horizontally until lateral contact is made between the sides of the upstanding members and the contacting surfaces of the panels. The only exception to this rule would be a case in which three gridding pads already are in position, such as just before the installation of panel 199 in FIG. 22. In such a case, panel 199 would be lowered onto the gridding pads and then pushed generally toward panel 185 such that panel 199 is located by gridding pads 170 and 172. Thereafter, it would be desirable to push gridding pad 173 generally in the directions of panels 198 and 199 so as to remove any gaps that may have developed and to position pad 173 for its future use in locating a yet-to-be-installed panel.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A self-gridding access flooring system comprising:

a plurality of access flooring panels adapted to be contiguously and removably installed above a sub-floor so as to create a chamber between said sub-floor and undersides of said panels, said plurality of panels having a plurality of leg members connected thereto having first, second and third side portions and having nominal dimensions, individual panels of said plurality having actual dimensions falling within known ranges of tolerance with respect to said nominal dimensions; and gridding means comprising means for establishing a gridding of said flooring system by contacting, positioning and spacing said panels from one another during installation of said panels above a sub-floor so as to create said chamber, means for assuring that said spacing is such that any one of said panels may be removed and replaced by any geometrically similar replacement panel having the same nominal dimensions and the same known tolerance ranges without interference between the replacement panel and the panels contiguous thereto; and support means upon which said leg members are mounted wherein said means for assuring said spacing comprises deformable spacer means fixedly mounted on said support means for engaging first and second side portions of said leg members and being deformed to accommodate any replacement panel having the nominal dimensions and the same known tolerance ranges, said support means including at least one retainer for engaging said third side portion of said leg members and retaining said leg members in position.

2. A flooring system as claimed in claim 1, wherein said gridding means comprises a gridding pad, said gridding pad comprising a base for supporting portions of a plurality of contiguously-installed panels and a plurality of contacting means for contacting said panels during the installation thereof, for establishing said spacing by said contact, and for establishing locations for installation of said panels by said contact.

3. A flooring system as claim in claim 1, wherein:

said ranges of tolerance are such that, if a small panel having actual dimensions at negative extremes of said tolerance ranges were centered atop a large panel having actual dimensions at positive extremes of said tolerance ranges, edges of the large panel would lie laterally outward beyond edges of the small panel by a horizontal distance e; and said gridding means comprises means for establishing a spacing between two contiguous panels during the installation thereof above a sub-floor, said spacing being taken at a point of minimum distance between the contiguous panels.

4. A self-gridding access flooring system comprising:

a plurality of access flooring panels adapted to be continuously and removably installed above a sub-floor so as to create a chamber bet ween said sub-floor and undersides of said panels, said plurality of panels having nominal dimensions, individual panels of said plurality having actual dimensions falling within known ranges of tolerance with respect to said nominal dimensions and having a plurality of leg members connected thereto, said leg members having a first, second and third side portion; and gridding means comprising means for establishing a gridding of said flooring system by contacting, positioning and spacing said legs of said panels from one another during installation of said panels above a sub-floor so as to create said chamber, means for assuring that said spacing is such that any one of said panels may be removed and replaced by any geometrically similar replacement panel having the same nominal dimensions and the same know tolerance ranges without interference between the replacement panel and the panels contiguous thereto, and deformable means capable of deforming to accommodate any replacement panel having the same nominal dimensions and the same known tolerance ranges wherein said gridding means comprises a gridding pad, said gridding pad comprising a base for supporting portions of a plurality of contiguously-installed panels and a plurality of contacting means for contacting said panels during the installation thereof, for establishing said spacing by said contact, and for establishing locations for installation of said panels by said contact, said contacting means comprising a plurality of upstanding members mounted on said base of said gridding pad, said upstanding members being disposed in pairs, each said pair being disposed between contiguous panels for laterally contacting said panels, and including at least one retainer for engaging said third side portion of said leg members and retaining said leg members in position

5. A flooring system as claimed in claim 4, wherein first and second upstanding members of a said pair are configured to provide for the movement of at least a portion of one of said members toward the other of said members when forced by contact with the sides of a replacement panel.

6. A process of self-gridding and installing an access flooring system above a sub-floor comprising the steps of:

(a) providing a plurality of flooring panels having a plurality of leg members connected thereto, said leg members having first, second and third side portions and adapted to be contiguously and removably installed respectively on a plurality of support members above a sub-floor upon which said leg members are mounted so as to create a chamber between said sub-floor and undersides of said panels, the panels having nominal dimensions, individual ones of said panels having actual dimensions falling within known ranges of tolerance with respect to the nominal dimensions;

(b) fixing at least one deformable gridding member on each of said support members for engaging said leg members of said panels and being deformed;

(c) installing one of said panels above the sub-floor;

(d) installing a next panel above the sub-floor contiguous to a previously-installed panel;

(e) during said step of installing a next panel, using simultaneous contact among said previously-installed panel, said next panel and the at least one gridding member to establish a position of said next panel and to establish a spacing of said next panel from said previously-installed panel;

(f) repeating steps (d) and (e) a sufficient number of times until a desired number of panels is installed and said chamber is created; and (g) during steps (d), (e) and (f), deforming said at least one gridding member by engaging with said first, second and third side portions of said leg members of said panels so as to assure that the spacing of a panel from all contiguous panels is sufficient that the panel may be removed and replaced by any replacement panel having the same nominal dimensions and the same know tolerance ranges without interference between the replacement panel and the contiguous panels.

* * * * *

UNITED STATES PATENT AND TRADEMARK OFFICE

CERTIFICATE OF CORRECTION

PATENT NO. : 4,835,924

DATED : JUNE 6, 1989

INVENTOR(S) : PETER A. BLACKLIN et al

It is certified that error appears in the above-identified patent and that said Letters Patent is hereby corrected as shown below:

In column 2, line 29, change "location" to --location.--.

In column 4, line 19, change "to" to --top--;

line 53, change "LN" to --$L_N$--;

line 60, change "LL" to --$L_L$--;

line 61, change "is it is" to --is it--.

In column 5, line 32, change "Acocrd-" to --Accord---;

line 68, change "zero" to --zero.--.

In column 6, line 15, change "thereto" to --thereto.--;

line 45, change "s" to --so--.

In column 9, line 13, change "i.e," to --i.e.--;

line 17, change "simplist" to --simplest--;

line 21, change "t" to --to--;

line 67, change "are" to --area--.

In column 10, line 55, change "legs" to --legs.--.

In column 11, line 23, change "t" to --to--.

In column 12, line 29, change "within a" to --within--.

In column 14, line 20, change "17014 173" to --170-173--.

UNITED STATES PATENT AND TRADEMARK OFFICE

CERTIFICATE OF CORRECTION

PATENT NO. : 4,835,924

DATED : JUNE 6, 1989

INVENTOR(S) : PETER A. BLACKLIN et al

It is certified that error appears in the above-identified patent and that said Letters Patent is hereby corrected as shown below:

In column 16, line 1, change "as claim" to --as claimed--;

line 16, change "continuously" to --contiguously--;

line 17, change "bet ween" to --between--;

line 36, change "know" to --known--;

line 57, change "position" to --position.--.

In column 18, line 15, change "know" to --known--.

Signed and Sealed this

Tenth Day of July, 1990

*Attest:*

HARRY F. MANBECK, JR.

*Attesting Officer*

*Commissioner of Patents and Trademarks*